United States Patent [19]

Wallis

[11] Patent Number: 4,558,620

[45] Date of Patent: Dec. 17, 1985

[54] PUNCH RETAINER

[76] Inventor: Bernard J. Wallis, 25315 Kean Ave., Dearborn, Mich. 48124

[21] Appl. No.: 658,211

[22] Filed: Oct. 5, 1984

[51] Int. Cl.[4] ..... B26D 7/26; B26F 1/14

[52] U.S. Cl. ..... 83/698; 83/685; 83/691; 83/699; 83/700; 279/79

[58] Field of Search ..... 83/698, 699, 700, 685, 83/691; 279/79

[56] References Cited

U.S. PATENT DOCUMENTS

| | | | |
|---|---|---|---|
| 3,106,122 | 10/1963 | Newcomb | 83/698 |
| 3,245,694 | 4/1966 | Parker | 83/698 X |
| 3,563,124 | 2/1971 | Gargrave | 83/698 |
| 4,377,100 | 3/1983 | Wallis | 279/79 X |

*Primary Examiner*—Donald R. Schran

*Attorney, Agent, or Firm*—Barnes, Kisselle, Raisch, Choate, Whittemore & Hulbert

[57] ABSTRACT

The punch retainer mounted on a die shoe has a body with a backing plate fastened to the top face thereof. The body is formed with a first bore for retaining a punch, the inner end of which abuts the backing plate. A first dowel projecting from the mounting face of the die shoe extends into the backing plate in axial alignment with the central axis of the first bore. Second and third bores in the body register with second and third holes in the backing plate. Tubular dowels engage in the registering bores and holes to align the backing plate on the body. The retainer is mounted on a die shoe by holding screws which extend through the tubular dowels and thread into the die shoe. The backing plate is aligned on the die shoe by either a separate fourth dowel in the backing plate spaced remotely from the first dowel or by extending one of the tubular dowels beyond the backing plate for engagement with a registering opening in the die shoe.

10 Claims, 5 Drawing Figures

PUNCH RETAINER

This invention relates to punch retainers.

In punching holes in metal parts each punch is normally mounted in a retainer which is in turn mounted on a die shoe in a press. The punch retainer normally comprises a steel body having a through bore in which the punch is removably secured. A hardened steel backing plate is normally interposed between the retainer body and the die shoe to prevent the inner end of the punch from being driven into the soft steel of the die shoe.

In order to punch accurately located holes in a workpiece it is essential that the punch retainer is very accurately positioned on the die shoe since the workpiece is accurately located on the die shoe by suitable locators. Position accuracy of the retainer on the die shoe is best obtained through the use of dowels. In the case of punches for round holes, this accuracy can be achieved by a single dowel between the backing plate and die shoe accurately aligned with the central axis of the punch bore. This requires accurate alignment of the backing plate relative to the retainer body to insure exact alignment of the dowel opening in the backing plate with the central axis of the punch bore. With such an arrangement any slight rotation of the retainer arund the central axis of the dowel will not affect the accuracy of the punch location.

In the case of noncircular punches, a single dowel will not assure accurate positional orientation of the punch retainer relative to the noncircular hole to be punched in the workpiece. Therefore, in the case of noncircular punches it is desirable to utilize at least two dowel pins to locate the punch in the desired position on the die shoe. Furthermore, the dowels should be relatively widely spaced in order to achieve a high degree of accuracy. Even in the case of noncircular punches, additional means must be provided for properly aligning the backing plate relative to the retainer body.

If the holes to be punched in the workpiece are spaced close together the retainers should be relatively small in size and shaped so that they can be closely nested. Nevertheless, the retainer body must be sufficiently large to accommodate all the holes required for the mounting screws and the alignment dowels. Thus, a suitably designed punch retainer should include at least two mounting screws for securing the retainer on the die shoe, one or more dowels for aligning the retainer body relative to the backing plate, and also dowels for accurately locating the assembly of the retainer body and backing plate on the die shoe.

The present invention has for its primary object the provision of a compact, high-strength punch retainer designed to be accurately located on a die shoe in a unique manner.

A further object of this invention is to provide a punch retainer having a unique and space-saving arrangement of through holes for accommodating the mounting screws as well as holes for accommodating dowels for accurately aligning the backing plate with both the die shoe and the punch retainer body.

Other objects, features and advantages of the present invention will become apparent from the following description and accompanying drawings, in which.

Figure 1:
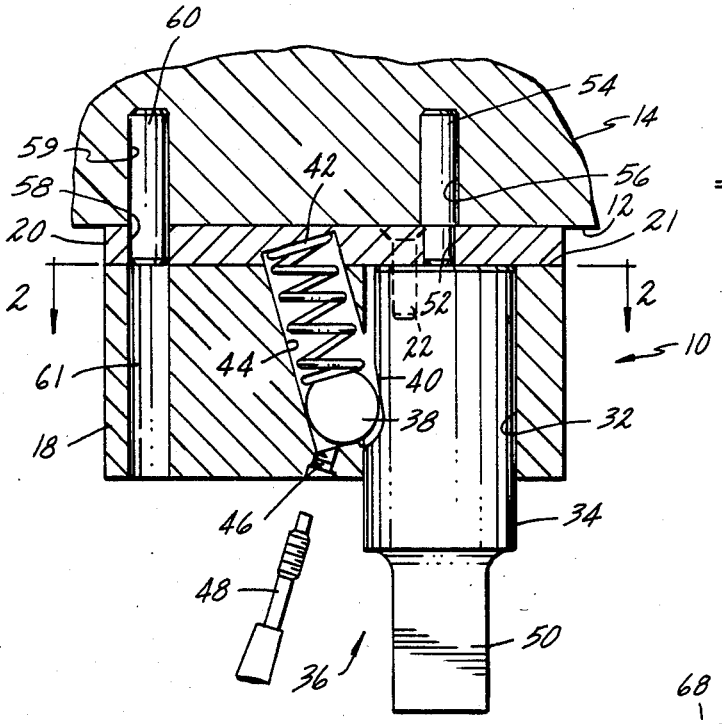
FIG. 1 is a vertical sectional view of one form of punch retainer according to the present invention taken along the line 1—1 in FIG. 2.
Figure 2:
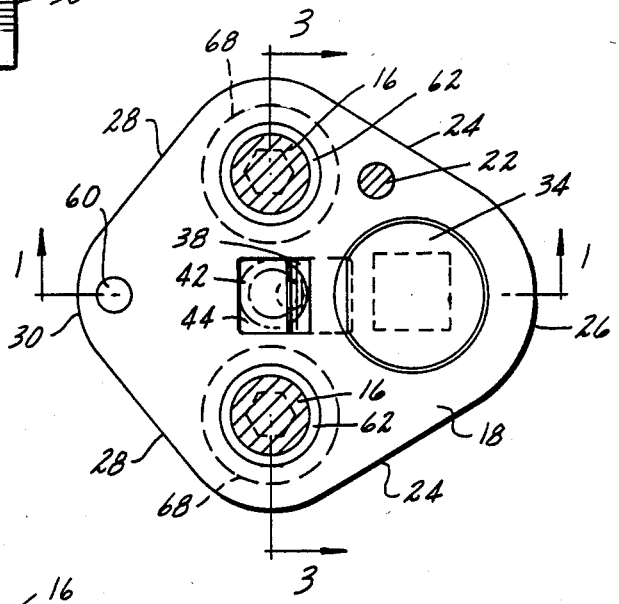
FIG. 2 is a top plan view of the retainer body taken along the line 2—3 in FIG. 1.
Figure 3:
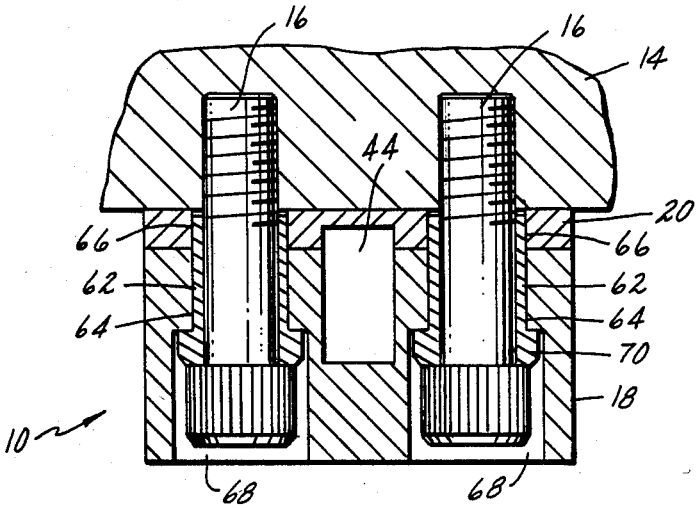
FIG. 3 is a fragmentary sectional view taken along the line 3—3 in FIG. 2.

In the arrangement illustrated in FIGS. 1 thru 3 a punch retainer 10 is secured to the mounting face 12 of a die shoe 14 by a pair of headed mounting screws 16. Punch retainer 10 has a body 18 and a backing plate 20 secured to the top flat face 21 thereof by a screw 22. As shown in FIG. 2, body 18 has a pair of side faces 24 which converge to a rounded apex 26. Body 18 has a second pair of side faces 28 which extend from the ends of the divergent faces 24 and converge to a rounded apex 30. The outer periphery of backing plate 20 is of the samd size and configuration as the outer periphery of body 18.

Between the converging faces 24 and adjacent apex 26 body 18 is formed with a circular bore 32 which is perpendicular to the top face of the body. The circular cylindrical shank 34 of a punch 36 is adapted to be releasably retained in bore 32 by a roller 38 engaging an inwardly inclined face portion 40 on the punch shank. Roller 38 is biased into engagement with the inclined face 40 by a compression spring 42. Roller 38 and spring 42 are housed in a cavity 44 in body 18 and backing plate 20. An opening 46 in the bottom face of body 18 extending into the lower end of cavity 44 is adapted to accommodate a tool 48 for displacing roller 38 upwardly out of engagement with the inclined face 40 to permit removal and insertion of punch 36. Punch 36 has a noncircular punching end 50.

Backing plate 20 has an accurately sized hold 52 which, when the backing plate is properly aligned on the body 18, is accurately concentric to the central axis of bore 32. Hole 52 is adapted to receive a closely fitting dowel 54 that is engaged with an accurately located hole 56 in die shoe 14. Adjacent the apex 30, backing plate 20 is formed with a second accurately sized hole 58 which registers with a hole 59 in the mounting face 12 of die shoe 14. Holes 58,59 are adapted to receive a second closely fitting dowel 60 for aligning the backing plate on the die shoe. Dowels 54,60 are relatively widely spaced and insure accurate alignment of backing plate 20 relative to die shoe 14. In order to obtain the wide spacing of dowels 54,60 and yet maintain the retainer compact in size, the included angle between faces 24 is smaller than the included angle between faces 28. Preferably the included angle at apex 26 is about 60° and at apex 30 about 100°. If desired, a through bore 61 may be formed in body 18 in alignment with hole 58 to facilitate insertion of dowel 60 into holes 58,59 from the bottom side of retainer body 18.

In the arrangement illustrated in FIGS. 1–3 the accurate alignment of body 18 relative to backing plate 20 is obtained by two additional dowels 62. Dowels 62 are of tubular form and have a close fit in holes 64 in body 18 and registering holes 66 in backing plate 20. Holes 62 are counterbored, as at 68, and dowels 62 are provided with enlarged heads 70 which seat in counterbores 68. The inner diameter of tubular dowels 62 are sized to have a somewhat free fit with the shanks of mounting screws 16. The heads of screws 16 seat against the enlarged heads 70 of dowels 62.

In the above described arrangement it will be observed that the backing plate 20 is accurately aligned relative to body 18 by the tubular dowels 62 and the backing plate is accurately aligned relative to the shoe 14 by the dowels 54,60. In addition, it will be noted that, by forming the body 18 of the retainer somewhat in the shape of a diamond so that its length between apices 26 is greater than its width, dowels 54,60 can be relatively widely spaced apart. Dowels 62 are likewise relatively widely spaced. As pointed out previously, the wide spacing of the dowels is necessary to obtain a very high degree of accuracy in the alignment of the retainer on the die shoe.

Figure 4:
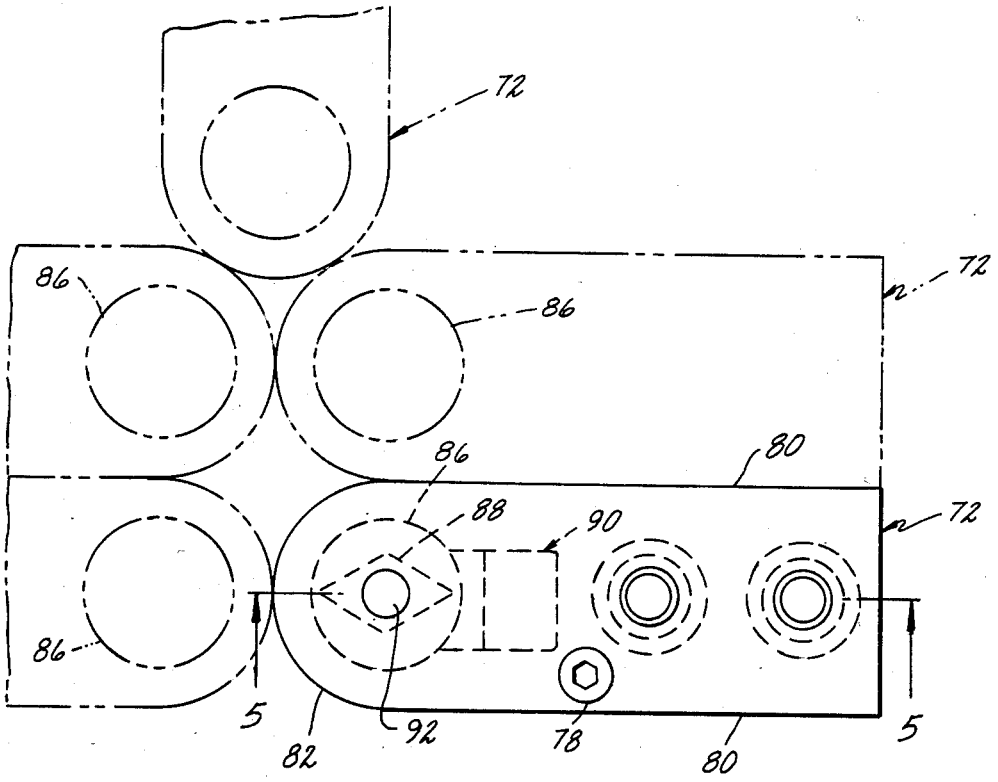
FIG. 4 is a plan view of an arrangement of several punch retainers of slightly modified construction.
Figure 5:
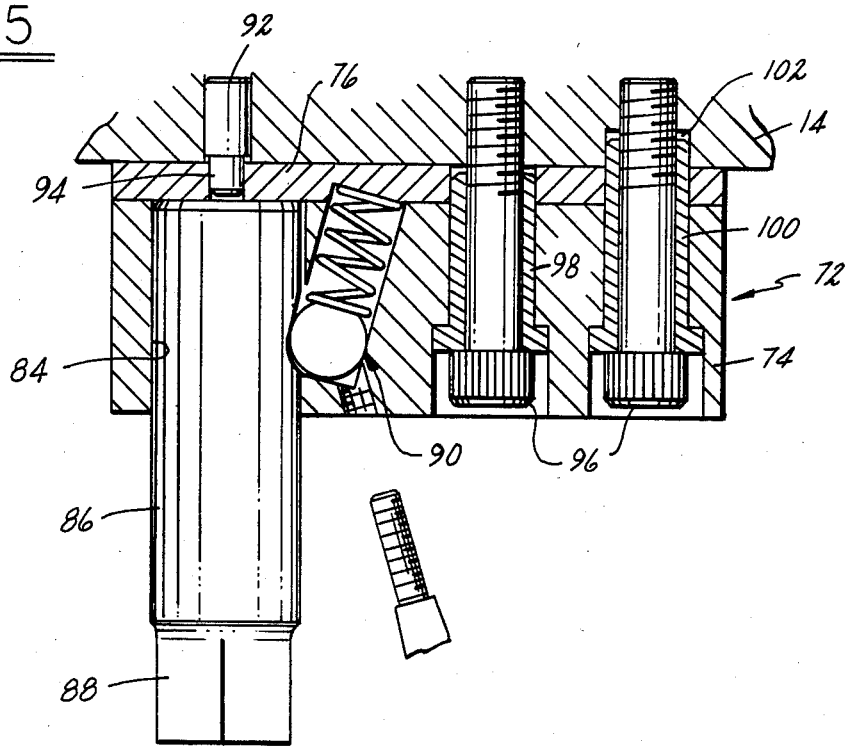
FIG. 5 is a sectional view along the 5—5 in FIG. 4.

In the arrangement shown in FIGS. 4 and 5 and the retainer 72 likewise comprises a body 74 having a backing plate 76 secured to the top face thereof by a screw 78. Unlike retainer 10 illustrated in FIGS. 1 thru 3, retainer 72 is generally in the form of an elongated rectangle having parallel flat side faces 80 and a rounded nose 82. Adjacent the nose 82 body 74 is formed with a cylindrical bore 84 for receiving the shank of a punch 86 having a noncircular punching end 88. A punch 86 is adapted to be releasably retained in bore 84 by a spring and roller arrangement 90 which is similar to the spring and roller arrangement described with reference to FIGS. 1 thru 3.

A dowel 92 projecting downwardly from die shoe 14 frictionally engages an opening 94 in backing plate 76, which, when the retainer is assembled, is accurately aligned concentric with the central axis of bore 84. The retainer 72 is mounted on die shoe 14 by a pair of headed mounting screws 96. Screws 96 extend through tubular dowels 98,100 which are similar in function to the previously-described tubular dowels 62. Dowels 98,100 serve to accurately align backing plate 76 on retainer body 74. However, the endmost tubular dowel 100 is frictionally engaged with holes extending not only through body 74 and backing plate 76, but also with a registering opening 102 in die shoe 14. Thus, dowel 100 provides an accurate alignment connection between backing plate 76 and body 74 and also between backing plate 76 and die shoe 14. For punching relatively closely spaced holes the retainers 72 are adapted to be nested in the manner illustrated in FIG. 4.

I claim:

1. A punch retainer comprising a body having a flat face, a first bore extending through said body perpendicular to said flat face, a backing plate secured to said flat face and overlying said bore, said backing plate being designed to abut a flat mounting face on a die shoe on which the retainer is adapted to be secured, means in said body for releasably retaining the shank of a punch in said bore with the inner end of the shank abutting said backing plate, said body also having second and third accurately sized bores therein spaced from said first bore, the ends of the second and third bores remote from said backing plate being counterbored, said backing plate having a first opening therethrough accurately aligned with the central axis of said first bore, a dowel having a close fit in said opening and adapted to have a close fit in a registering opening in the die shoe, said backing plate also having second and third accurately sized openings therethrough which are adapted to be aligned accurately concentric with the second and third bores in the body when the first opening in the backing plate is axially aligned accurately with the central axis of said first bore and tubular dowels engaged in the second and third registering bores and openings in the body and backing plate, said tubular dowels being adapted to receive with a free fit holding screws threaded into the die shoe and having heads which seat in said counterbores.

2. A punch retainer as called for in claim 1 wherein at least one of said tubular dowels extends through and outwardly beyond said backing plate for engagement with a registering hole in the die shoe.

3. A punch retainer as called for in claim 2 wherein said body has a length greater than its width, said first bore being located adjacent one end of the body and said tubular dowel being located adjacent the opposite end of the body.

4. A punch retainer as called for in claim 3 wherein said means for releasably retaining the punch shank in the first bore is located intermediate said first bore and said last-mentioned tubular dowel.

5. A punch retainer as called for in claim 1 wherein said body has a pair of side faces which converge to an apex, said first bore being located adjacent said apex, said second and third bores being triangularly related to said first bore and being located adjacent said side faces at the widest portion of the body, said body having a portion projecting from the widest portion of the body in a direction opposite from said first bore, said backing plate having a periphery generally coinciding and registering with the periphery of the body, the portion of the backing plate registering with the projecting portion of the body having an accurately sized fourth opening therethrough adapted to engage with a close fit a second dowel projecting from the mounting face of the die shoe.

6. A punch retainer as called for in claim 5 wherein said projecting portion of the body has a second pair of side faces which converge from the diverging ends of the first-mentioned side faces of the body, said second-mentioned side faces terminating in an apex located diametrically opposite said first-mentioned apex, said fourth opening in the backing plate being located adjacent the second apex.

7. A punch retainer as called for in claim 5 wherein the fourth opening in the backing plate is offset from a straight line connecting the centers of the second and third openings in a direction opposite from said first opening.

8. A punch retainer as called for in claim 5 wherein the angle of convergence of the second-mentioned side faces of the body is greater than the angle of convergence of the first-mentioned side faces.

9. A punch retainer as called for in claim 8 wherein the angle of convergence of the first-mentioned side faces is about 60° and the angle of convergence of the second-mentioned side faces is at least about 90°.

10. A punch retainer as called for in claim 1 wherein said first-mentioned dowel terminates between the opposite faces of the backing plate.

* * * * *